United States Patent [19]

Smith

[11] 3,947,315

[45] Mar. 30, 1976

[54] METHOD OF PRODUCING NON-WOVEN FIBROUS MATERIAL

[75] Inventor: Malcolm Kenneth Smith, Great Kingshill near High Wycombe, England

[73] Assignee: Wiggins Teape Research & Devel. Ltd., London, England

[22] Filed: May 12, 1971

[21] Appl. No.: 142,767

[52] U.S. Cl. ..... 162/101; 162/146; 162/204

[51] Int. Cl.[2] ..... D21D 3/00

[58] Field of Search ..... 162/101, 146, 135, DIG. 1, 162/204

[56] References Cited

UNITED STATES PATENTS

| | | | |
|---|---|---|---|
| 3,007,840 | 11/1961 | Wilcox | 162/101 |
| 3,032,465 | 5/1962 | Selke et al. | 162/146 |
| 3,121,660 | 2/1964 | Hall, Jr. | 162/DIG. 1 |
| 3,542,640 | 11/1970 | Friedberg et al. | 162/101 |
| 3,674,621 | 7/1972 | Miyamoto et al. | 162/146 |

*Primary Examiner*—Robert L. Lindsay, Jr.
*Assistant Examiner*—Peter Chin
*Attorney, Agent, or Firm*—John P. Snyder

[57] ABSTRACT

The invention relates to an improved method of making bulky non-woven fibrous material including cellulosic fibres and potentially crimped synthetic fibres, the improvement consisting of draining a layer of a foamed aqueous suspension of the fibres, drying the drained layer, and releasing the potential crimp in the synthetic fibres while supporting the layer substantially free from restraint against shrinkage.

9 Claims, No Drawings

METHOD OF PRODUCING NON-WOVEN FIBROUS MATERIAL

This invention relates to a method of producing bulky non-woven fibrous material, for example a paper.

When making bulky non-woven fibrous material from mixtures of cellulosic fibres and synthetic fibres it is essential to obtain some bonding between the different types of fibres.

It would be desirable to use crimped synthetic fibres in the mixture, as such fibres would impart enhanced interlocking and binding properties in the manufacture of the material, and would increase the wet strength of the material.

In practice, however, it is found that if crimped synthetic fibres are used in the manufacture of bulky non-woven fibrous material using conventional wet-laying paper-making methods, it is very difficult to obtain an even dispersion of the crimped synthetic fibres, unless expensive solvents or dispersing agents are used.

In order to overcome these problems it is known to produce bulky non-woven fibrous material by forming a web containing cellulosic fibres and potentially crimped synthetic fibres, and then heating the web to bring out the potential crimp in the synthetic fibres.

Potentially crimped synthetic fibres are normally two part fibres, the two parts being arranged in either a sheath-and-core or a side-by-side arrangement and being of chemically similar polymers, for example polyolefin, polyamide, or polyester, which differ in physical properties such as softening point, and shrinkage under the influence of heat at temperatures below the lower softening point of the two polymers.

However, the use of potentially crimped synthetic fibres as described above does not always give completely satisfactory results when the web is layed from an aqueous suspension of cellulosic fibres and potentially crimped synthetic fibres, on a conventional paper-making machine. One reason for this is that the fibres of the mixture are in intimate contact during drying of the web and release of the potential crimp in the synthetic fibres, and this contact offers resistance to shrinkage of the web, thus limiting bulking of the web.

According to this invention a method of producing bulky non-woven fibrous material, includes the steps of forming and draining a layer of a foamed suspension of cellulosic fibres and potentially crimped synthetic fibres, drying the layer when drained, and releasing the potential crimp in the synthetic fibres while the layer is supported substantially free from restraint against shrinkage.

The foamed suspension is preferably produced by the method described in British Patent Specification No. 1,129,757.

The use of a foamed suspension of fibres gives the advantage that the layer formed is a loosely bonded structure, and thus the restraint against bulking of the layer on release of the potential crimp in the synthetic fibres is lower than when a conventional aqueous suspension is used. This is a particular advantage when the cellulosic fibres are of a strongly bonding wood pulp.

Any wood pulp fibres can be used as the cellulosic fibres, but if strongly bonding wood pulp fibres, such as kraft pulp fibres, are used, a high percentage by fibre weight of synthetic fibres, for example above 50%, should be used. This ensures that the forces developed on release of the potential crimp in the synthetic fibres are sufficiently high to overcome the restraining effect of the cellulosic fibres and thus allow bulking to take place.

It follows that if a low percentage by fibre weight of synthetic fibres is to be used, for example below 30%, then the wood pulp fibres should be ones which do not bond strongly, such as high alpha wood pulp fibres.

The necessary support for the layer, substantially free from restraint against shrinkage, while the potential crimp in the synthetic fibres is released, can be provided by a smooth metal or polymeric, for example polytetrafluoroethylene, surface, or by an air support arrangement. Otherwise the necessary support can be provided by tenters which grip the edges of the layer and are arranged, for example in a convergent manner, to allow for shrinkage of the layer.

Potentially crimped fibres as described above can be bonded together by heating them when in contact with each other, to a temperature above the lower softening point of the fibre. Provided that the fibres are not heated to a temperature above the higher softening point of the fibre, the higher-softening-point part of each fibre will retain its shape and act as a reinforcement so that continuity and the individual strengths of the fibres bonded together will not be lost.

Drying of the layer, release of the potential crimp in the synthetic fibres, and bonding of the synthetic fibres can be effected either consecutively or simultaneously. For example, the layer can be dried at a temperature below that required to release the potential crimp in the synthetic fibres, then further heated to release the potential crimp in the synthetic fibres, and finally further heated to the temperature required for bonding of the fibres of the layer. Otherwise the layer can be dried at the temperature required for release of the potential crimp in the synthetic fibres, and then further heated to the bonding temperature of the synthetic fibres or the drying of the layer, release of the potential crimp in the synthetic fibres and bonding of the fibres of the layer can be effected in one operation by initial heating of the layer to the temperature required for bonding of the fibres of the layer.

The preferred percentages, by fibre weight, of fibres in the foamed aqueous suspension used in the method of this invention are between 80 and 20% of cellulosic fibres, and 20 and 80% of potentially crimped synthetic fibres. Such suspensions can readily be formed into a layer on the screen of a conventional Fourdrinier papermaking machine.

Material produced by the method of this invention can be pattern bonded by the application of localised heat and pressure, for example by pressing the material between heated plates, one or both of which is or are provided with a raised pattern as required. Otherwise the material can be passed between heated, patterned rollers, in for example an embossing press, or the material can be pressed between continuous patterned belts, for example wire mesh belts, by heated rollers. When pattern bonded the material has good strength and drape properties, and a pleasant surface texture.

If desired material produced by the method of this invention can contain polymeric or other bonding agents introduced by any of the usual methods such as beater addition, or dry layer saturation before, or preferably after, release of the potential crimp in the synthetic fibres.

Material produced by the method of this invention can be used for disposable clothing, disposable bed linen or blankets, clothing interlinings, or as a base material for synthetic leather and automotive fabrics.

Examples of the method of this invention are as follows.

EXAMPLE 1

Three mixtures of 6 mm long three denier all polyolefin potentially crimped synthetic fibres and weakly bonding cellulosic fibres were prepared containing respectively 25%, 50% and 75% by weight of synthetic fibres.

The three mixtures were then separately dispersed in an aqueous foam containing 65% air made from a 0.2% solution of a suitable surfactant by means of a Denver foaming unit, as described in British Patent Specification No. 1,129,757. Amounts of each aqueous suspension each containing sufficient fibres to make a 20 cm diameter, 60 g.s.m. sheet were then collapsed and drained on the wire of a Frank handsheet machine by the application of vacuum. Each sheet was then dried on a Johnsons Model 75 rotary drum drier at a temperature of 80°C. Some of the sheets were then heated on a smooth metal surface in an oven at a temperature of 110°C for two minutes, and other sheets were similarly treated at a temperature of 125°C.

The heated sheets were then compared against unheated control sheets by the following measurements:

Sheet diameter
Sheet thickness
Drape length (the length of a 2.5 cm wide strip sufficient to bend the strip through an angle of 45° under its own weight)
Tensile strength of a 3 cm. wide strip Extension at failure of a 3 cm. wide strip.

The results obtained were as given in Table 1.

TABLE 1

| Sheet property measured / Sheet composition and treatment | Diameter (cms) | Thickness (μm) | Drape length (2.5 cm. strip) (cms) | Tensile strength (3 cm. strip) kg | Extension at failure (3 cm. strip) |
|---|---|---|---|---|---|
| 25% potentially crimped fibres 75% weakly bonding cellulosic fibres | | | | | |
| unheated | 20 | 305 | 3.3 | 0.01 | 1.2% |
| heated to 110°C | 19.6 | 356 | 5.6 | 0.14 | 5.6% |
| heated to 125°C | 19.2 | 381 | 7.4 | 0.23 | 10.4% |
| 50% potentially crimped fibres 50% weakly bonding cellulosic fibres | | | | | |
| unheated | 20 | 305 | 2.0 | too low to measure | too low to measure |
| heated to 110°C | 18.5 | 381 | 7.6 | 0.19 | 14.5% |
| heated to 125°C | 16.1 | 533 | 10.4 | 0.43 | 23.2% |
| 75% potentially crimped fibres 25% weakly bonding cellulosic fibres | | | | | |
| unheated | 20 | — | 2.5 | too low to measure | too low to measure |
| heated to 110°C | 14.5 | 533 | 7.1 | 0.14 | 18.4% |
| heated to 125°C | 13.2 | 889 | 7.9 | 0.70 | 32.7% |

EXAMPLE 2

Three mixtures of 19 mm long three denier potentially crimped composite polyolefin/polyester synthetic fibres and weakly bonding cellulosic fibres were made containing respectively 30%, 45% and 60% by weight of synthetic fibres. The mixtures were separately dispersed in an aqueous foam, containing 65% air made from an 0.2% solution of a suitable surfactant by means of a Denver foaming unit, as described in British Patent Specification No. 1,129,757. Portions of each dispersion each containing sufficient fibres to make a 20 cm diameter, 60 g.s.m. sheet were then collapsed and drained on the wire of a Frank handsheet machine by the application of vacuum. Each sheet was dried on a Johnsons Model 75 rotary drum drier at a temperature of 80°C. Some of the sheets were heated on a smooth metal plate in an oven at a temperature of 90°C for two minutes and other sheets were similarly treated at a temperature of 125°C.

The heated sheets were then compared against unheated control sheets by the following measurements:

Sheet diameter
Sheet thickness
Drape length (the length of a 2.5 cm wide strip of material sufficient to bend the material through an angle of 45° under its own weight)
Tensile strength of a 3 cm wide strip
Extension at failure of a 3 cm wide strip.

The results obtained were as given in Table 2.

TABLE 2

| Sheet property measured / Sheet compositon and treatment | Diameter (cms) | Thickness (μm) | Drape length (2.5 cm. strip) (cms) | Tensile strength (3 cm. strip) kg/30 min. | Stretch % |
|---|---|---|---|---|---|
| 30% potentially crimped fibres | | | | | |

TABLE 2-continued

| Sheet property measured / Sheet compositon and treatment | Diameter (cms) | Thickness (μm) | Drape length (2.5 cm. strip) (cms) | Tensile strength (3 cm. strip) kg/30 min. | Stretch % |
|---|---|---|---|---|---|
| 70% weakly bonding cellulosic fibres | | | | | |
| unheated | 20.0 | 306 | 3.6 | too low to measure | too low to measure |
| heated to 90°C | 16.6 | 410 | 3.9 | 0.04 | 8.7 |
| heated to 125°C | 16.1 | 49 | 7.1 | 0.20 | 2.2 |
| 45% potentially crimped fibres | | | | | |
| 55% weakly bonding cellulosic fibres | | | | | |
| unheated | 20.0 | 325 | 2.9 | too low to measure | too low to measure |
| heated to 90°C | 13.6 | 610 | 5.1 | 0.05 | 12.8 |
| heated to 125°C | 13.5 | 710 | 8.7 | 0.35 | 6.5 |
| 60% potentially crimped fibres | | | | | |
| 40% weakly bonding cellulosic fibres | | | | | |
| unheated | 20.0 | 335 | 3.3 | too low to measure | too low to measure |
| heated to 90°C | 11.3 | 840 | 5.9 | 0.08 | 14.9 |
| heated to 125°C | 11.4 | 970 | >11.0 | 0.37 | 9.5 |

I claim:

1. In the method of making bulky non-woven fibrous material which entails forming a web from an aqueous suspension containing cellulosic fibers and potentially crimped synthetic fibers having two parts of different softening point temperatures and heating such web to bring out the potential crimp in the synthetic fibers, the improvement which comprises:

a. controlling the proportions of cellulosic fibers and potentially crimped two part synthetic fibers in said aqueous suspension to assure at most weak bonding among the fibers prior to the heating which effects attainment of crimping;

b. foaming said aqueous suspension and depositing it as a layer in such foamed condition;

c. forming said web with weak bonding by draining and then drying the layer of step (b); and then d. releasing the potential crimp of said synthetic fibers by heating said web while supported substantially free from restraint against shrinkage to a temperature below the lower of said softening point temperatures whereby to produce a bulky non-woven fibrous material.

2. A method as claimed in claim 1, in which the cellulosic fibres are wood pulp fibres.

3. A method as claimed in claim 2, in which the wood pulp fibres are strongly bonding, and in which above 50%, by fibre weight, of synthetic fibres are used.

4. A method as claimed in claim 2, in which the wood pulp fibres are high alpha fibres, and in which less than 30%, by fibre weight, of synthetic fibres are used.

5. A method as claimed in claim 1, including the further step of heating the non-woven material to a temperature above said lower softening point temperature of the synthetic fibres but below the higher softening point temperature of the synthetic fibres, thereby to bond the fibres in the layer together.

6. A method as claimed in claim 5, in which the layer is dried at a temperature below that required to release the potential crimp in the synthetic fibres, then further heated to release the potential crimp in the synthetic fibres, and finally further heated to the temperature required for bonding of the fibres of the layer.

7. A method as claimed in claim 5, in which the layer is dried at the temperature required for release of the potential crimp in the syhthetic fibres, and then further heated to the bonding temperature of the synthetic fibres.

8. A method as claimed in claim 5, in which drying of the layer, release of the potential crimp in the synthetic fibres, and bonding of the fibres of the layer are effected in one operation by initial heating of the layer to the temperature required for bonding of the fibres of the layer.

9. A method as claimed in claim 1, in which a bonding agent is introduced into the material after release of the potential crimp in the synthetic fibres.

* * * * *

UNITED STATES PATENT AND TRADEMARK OFFICE

CERTIFICATE OF CORRECTION

PATENT NO. : 3,947,315

DATED : March 30, 1976

INVENTOR(S) : Malcolm Kenneth Smith

It is certified that error appears in the above-identified patent and that said Letters Patent are hereby corrected as shown below:

[30] Application Priority Data

British application no. 25222/70, filed May 26, 1970

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*